US006397550B1

(12) United States Patent
Walker et al.

(10) Patent No.: US 6,397,550 B1
(45) Date of Patent: Jun. 4, 2002

(54) METAL STRUCTURAL MEMBER

(76) Inventors: Steven H. Walker, 2415 Chinook Trail, Maitland, FL (US) 32751; Raymond C. Frobosilo, 253 Blackheath Rd., Lido Beach, NY (US) 11561

( * ) Notice: Subject to any disclaimer, the term of this patent is extended or adjusted under 35 U.S.C. 154(b) by 0 days.

(21) Appl. No.: 09/438,274

(22) Filed: Nov. 12, 1999

(51) Int. Cl.[7] ..... E04C 1/00

(52) U.S. Cl. ..... 52/653.1; 52/653.2; 52/733.2; 52/733.3; 52/732.1; 52/730.1; 52/731.9; 52/729.5; 52/731.7; 52/730.6; 52/731.5

(58) Field of Search ..... 52/653.1, 653.2, 52/733.2, 733.3, 732.1, 730.1, 731.9, 729.5, 731.7, 730.6, 731.5

(56) References Cited

U.S. PATENT DOCUMENTS 4,455,806 A * 6/1984 Rice ..... 52/732
4,619,098 A * 10/1986 Taylor ..... 52/738
5,501,053 A * 3/1996 Goleby ..... 52/729.5
6,115,986 A * 9/2000 Kelly ..... 52/731.9
6,205,740 B1 * 3/2001 Ekerholm ..... 52/733.2

* cited by examiner

*Primary Examiner*—Carl D. Friedman
*Assistant Examiner*—Christy Green
(74) *Attorney, Agent, or Firm*—Clifford G. Frayne

(57) ABSTRACT

A metal structural member having an elongate web member having a first side and a second side, a pair of flanges extending laterally from the first side of the web member, each of the flanges having an outer wall member and an end wall member, the end wall member being substantially parallel to the web member wherein one of the flanges further includes an inner wall member in spaced-apart relationship with the outer wall member and extending from the end wall member toward the web and terminating with a lip member formed parallel to and juxtaposed with the web.

8 Claims, 3 Drawing Sheets

FIG. 6
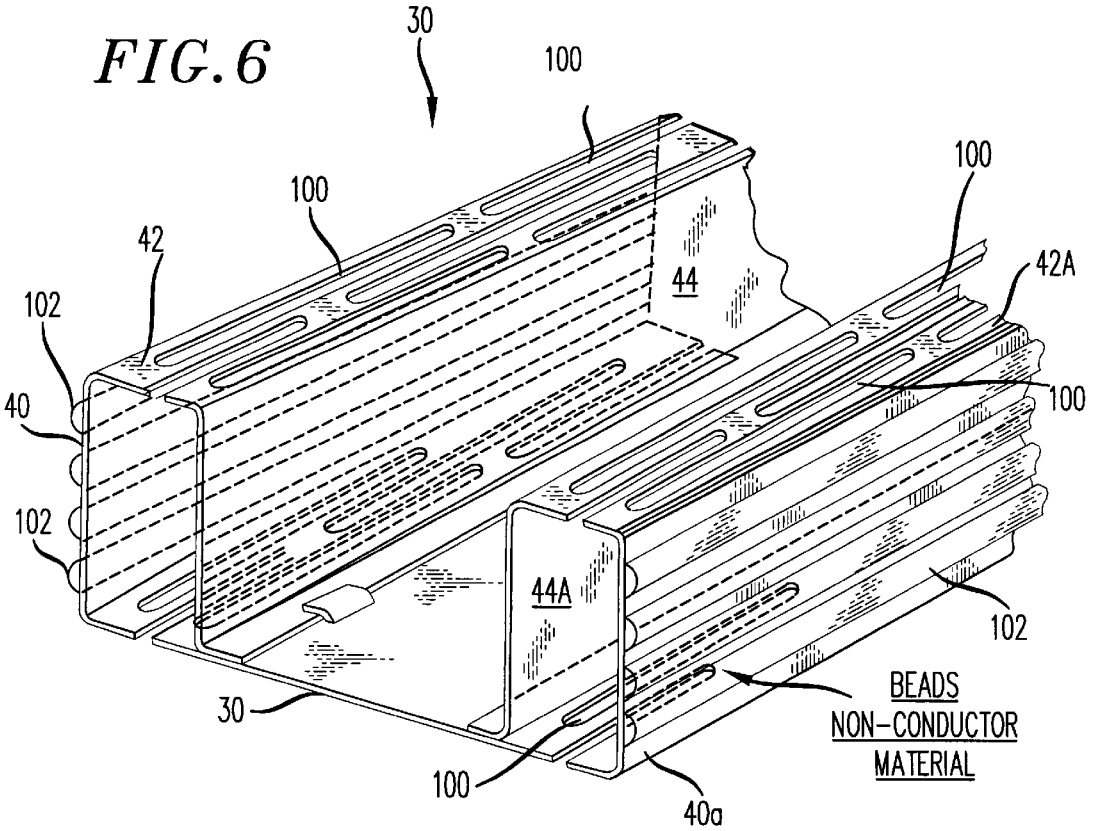
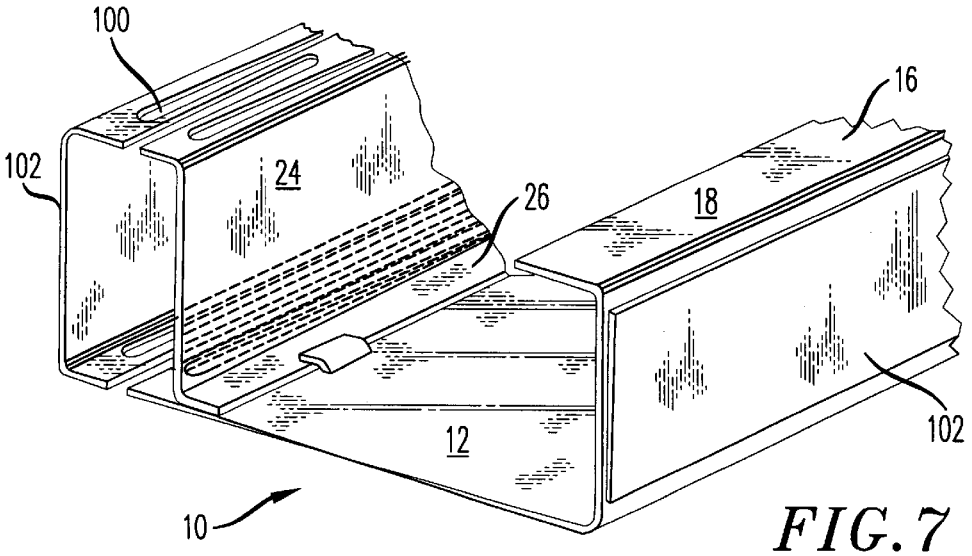
FIG. 7

METAL STRUCTURAL MEMBER

BACKGROUND OF THE INVENTION

1. Field of the Invention

The present invention relates to a metal structural member and in particular, to an improved C-section structural member having improved fastening and thermal conductivity characteristics.

2. Description of the Prior Art

The rising cost of lumber has caused increased interest in fabricating and constructing homes with frames of metal construction members. These construction members include roof joists, trusses, exterior walls and interior walls.

One of the main structural elements utilized in such metal frame construction is commonly referred to as the C-stud or C-shaped stud or member. Its name is derived from its cross section which resembles the letter C and comprises a longitudinal web having flanges depending from the longitudinal edges of the web to the same side of the web and flanges being substantially parallel to each other and perpendicular to the web. Such C-shaped members are used as the vertical support members for exterior and interior walls and are positioned at their tops and bottoms in a rail or track which is essentially a C-shaped member positioned in a horizontal configuration with the vertical C-shaped stud positioned within the rails and tracks such that the respective flanges of the vertical C-shaped stud and the horizontal C-shaped track are secured together to form the framework for a wall.

A particular short coming with the C-shaped studs as currently utilized in the construction industry is that the flanges depending from the central elongate web portion are normally of one ply and therefore a nail fastener securing an outer sheathing or inner sheathing to the C-shaped web member may become dislodged over time. This is particularly common with respect to a C-shaped stud member forming the exterior wall of the house. Typically the exterior sheathing will consist of ply wood which is normally secured by a nail fastener while the interior wall may consist of gypsum board or dry wall which may be secured by a threaded fastener or a nail. The fact that the nail penetrates the sheathing, be it the ply wood or the gypsum board, and then through one ply of the C-shaped stud member results in a nail fastener which essentially has a pivot point at its intersection with the flange of the C-shaped stud member. The vibration, loading or the like may cause this nail fastener to become dislodged from the flange member of the C-shaped stud member or to angularly rotate about the pivot point, thereby affecting the integrity of the exterior sheathing or the interior sheathing.

Applicant's C-shaped metal construction member provides for a double walled, spaced apart flange on the C-shaped stud member in order to provide the fastener with two contact points. The same double walled, spaced apart flange also provides improved connection when a threaded fastener is utilized.

In addition to the above identified improved C-section metal construction member, the construction member can also be formed to reduce thermal conduction from the exterior flange which is in communication with the exterior sheathing to the flange which is in communication with the interior sheathing thereby lessening concerns with respect to heat loss or heat gain within the building.

OBJECTS OF THE INVENTION

An object of the present invention is to provide for a novel metal construction member of C-shaped configuration having a double walled spaced apart flange.

A further object of the present invention is to provide for a novel C-shaped metal construction member in which both flanges are double walled and spaced apart.

A still further object of the present invention is to provide for a novel C-shaped metal construction member which decreases thermal conductivity between the outer sheathing and the inner sheathing of an exterior wall of a building.

SUMMARY OF THE INVENTION

A C-shaped metal construction member having an elongate longitudinal web having a first flange and a second flange depending from the longitudinal edge of the web, one or both of the longitudinal flanges being formed of a double wall, spaced apart configuration for improved frictional engagement with a fastening means utilized to secure sheathing to one or both of the flanges. The C-shaped metal stud construction member further comprising a means for reducing the thermal conductivity from flange to flange without affecting the integrity of the C-shaped construction member.

BRIEF DESCRIPTION OF THE DRAWINGS

These and other objects of the present invention will become evident particularly when taken in light of the following illustrations wherein:

FIG. 6 is a perspective end view of FIG. 2 illustrating a means by which the thermal conductivity across the C-shaped member may be reduced; and FIG. 7 is a prospective end view of FIG. 1 illustrating a means by which thermal conductivity across the C-shaped member may be reduced.

DETAILED DESCRIPTION OF THE DRAWINGS

Figure 1:
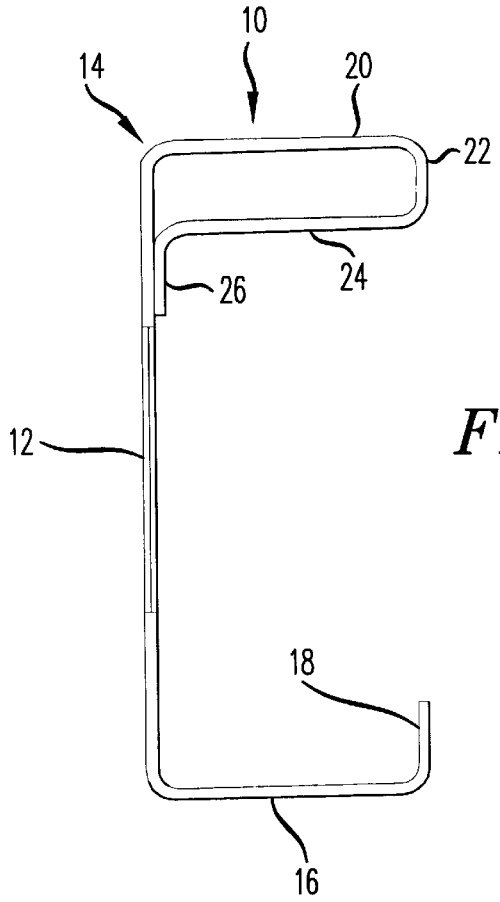
FIG. 1 is a cross sectional view of a first embodiment of the C-shaped construction member.

FIG. 1 is a cross-sectional view of a first embodiment of the C-section member 10. It comprises a longitudinal, elongate web member 12 having a hollow flange member 14 formed along one longitudinal edge thereof extending laterally from one side of the web 12 and a second flange member 16 formed along the opposing longitudinal edge extending laterally from the same side of the web as hollow flange member 14, flange member 16 having an end wall member 18 formed substantially parallel to web member 12.

Hollow flange member 14 is formed from web member 12 with an outer wall 20, an end wall 22 and an inner wall 24, inner wall 24 in spaced apart relationship to outer wall 20. End wall 22 of hollow flange member 14 is in substantially the same plane as end wall member 18 of second flange member 16 and substantially parallel to web 12. In this embodiment, outer wall 20 and inner wall 24 are substantially parallel to each other. Inner wall 24 terminates with a lip member 26 which is juxtaposed with web member 12. The lip member 26 may or may not be secured to web member 12, however, if it is secured, it could be secured by any suitable fastening means including a clinch punch.

Figure 2:
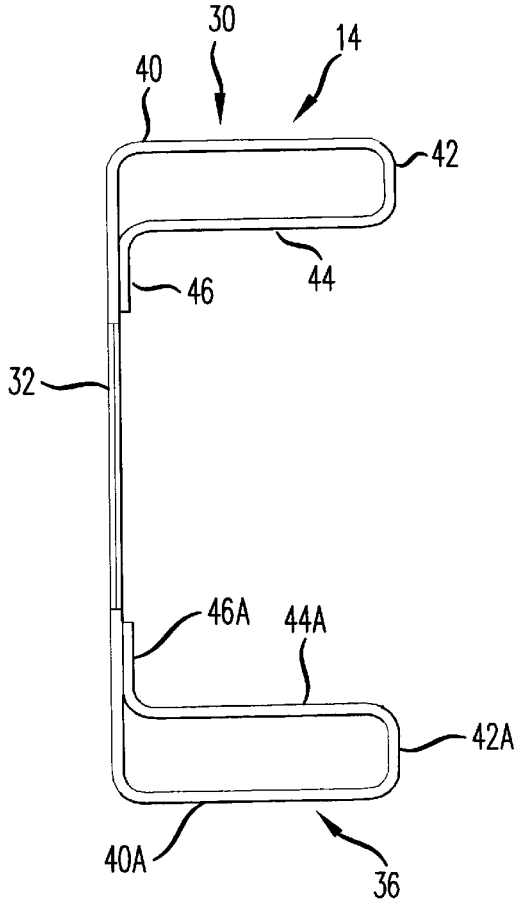
FIG. 2 is a cross section of a second embodiment of the C-shaped construction member.

FIG. 2 is a cross-sectional view of a second embodiment of a C-section member 30. It comprises a longitudinal elongate web member 32 having a first hollow flange member 34 formed along one longitudinal edge thereof extending laterally from one side of web 32 and a second hollow flange member 36 formed along the opposing longitudinal edge of web member 32 and extending laterally to the same side of the web as first hollow flange member 34.

First and second hollow flange members 34 and 36 are comprised of structural members identical to that of hollow flange member 14 of the first embodiment of the C-section member. Namely, each has an outer wall 40 and 40*a*, an end wall 42 and 42*a*, and an inner wall 44 and 44*a*, inner wall 44 and 44*a* in spaced apart relationship to outer wall 40 and 40*a*. End walls 42 and 42*a* of first hollow flange member 34 and second hollow flange member 36 would be in substantially the same plane and substantially parallel to web 32. Inner walls 44 and 44*a* of first hollow flange member 34 and second hollow flange member 36 would terminate with a lip member 46 and 46*a* which would be juxtaposed with web member 32.

Figure 3:
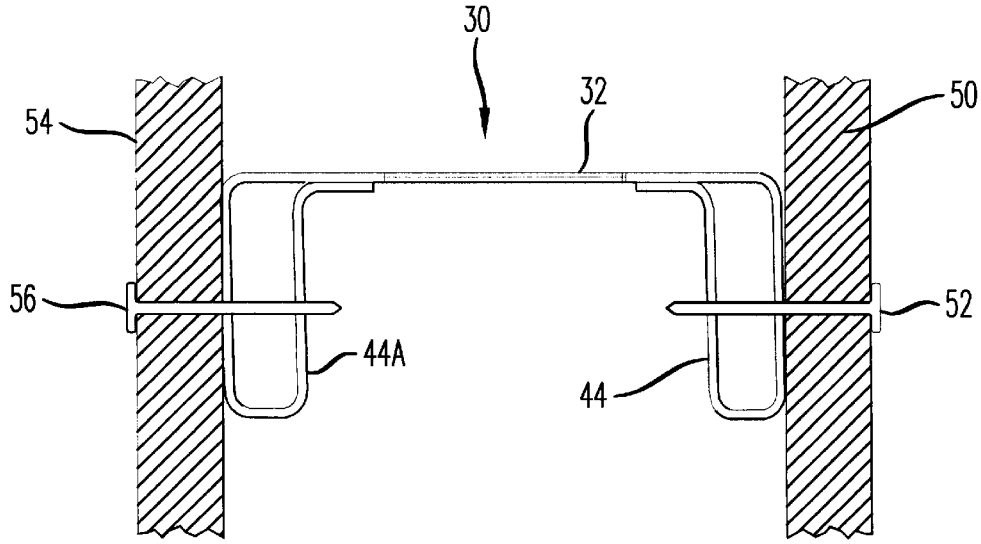
FIG. 3 is a top cross-section view of the C-shaped member of FIG. 2 with interior and exterior sheathing.

The advantages of the C-section member 10 or the alternative embodiment C-section member 30 are illustrated in FIG. 3 which is a top cross-sectional view of C-section member 30 having sheathing members secured thereto. With respect to the exterior of a building, sheathing of any type, but typically plywood or composition plywood 50 is typically utilized and this sheathing material 50 is normally secured by means of a nail member 52. The interior sheathing 54 of a building is typically dry wall of gypsum board which is oftentimes secured by a threaded fastener 56 or by a nail member 52. The C-section member of the present invention provides a hollow flange member proximate to at least the exterior sheathing of the building such that the nail member 52 will penetrate the sheathing and the outer wall and inner wall of the C-section member, thus giving the nail member 52 two contact points in the stud member which provides further stability to the nail member.

The threaded fastener 56 utilized on the interior sheathing 54 is sufficiently secured by penetration through a single wall of a flange member. Therefore in the instance when threaded fasteners are used on the interior sheathing 54, a C-section member of the type illustrated in FIG. 1 may be used. If nails and/or a combination of nails and threaded fasteners are going to be used on the interior sheathing, then an embodiment of the C-section member as illustrated in FIG. 2 would be used in order to provide the nail with two points of contact with the C-section member.

Figure 4:
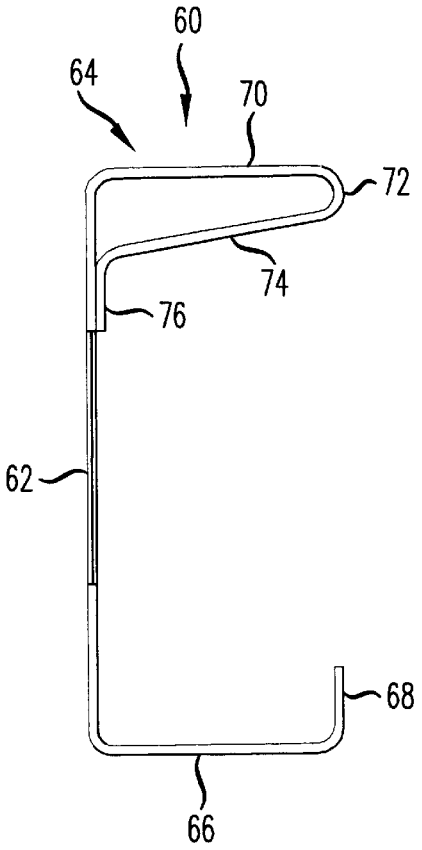
FIG. 4 is a third embodiment of the C-shaped construction member.
Figure 5:
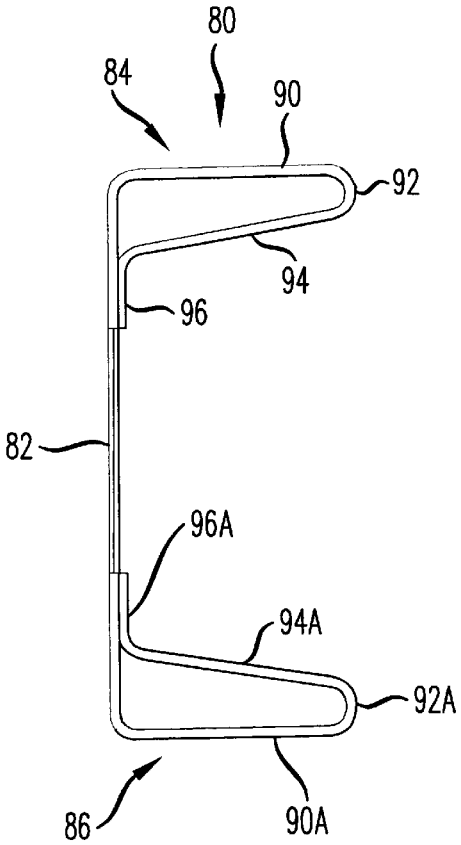
FIG. 5 is a cross section of a fourth embodiment of the C-shaped cross section member.

FIGS. 4 and 5 illustrate further embodiments of the present invention, FIG. 4 being a C-section member in accordance with the teachings of the C-section member of FIG. 1 and FIG. 5 being a C-section member in accordance with the teachings of FIG. 2.

FIG. 4 illustrates a C-sectioned member 60 comprised of a longitudinal, elongate web member 62 having a hollow flange member 64 formed along one longitudinal edge thereof extending laterally from one side of the web 62 and a second flange member 66 formed along the opposing longitudinal edge extending laterally from the same side of the web as hollow flange member 64, flange member 66 having an end wall member 68 formed substantially parallel to web member 62.

The hollow flange member 64 is formed from web member 62 with an outer wall 70, an end wall 72 and an inner wall 74, inner wall 74 being in spaced apart non-parallel relationship to outer wall 70. End wall 72 of hollow flange member 64 is in substantially the same plane as end wall member 68 of second flange member 66 and substantially parallel to web 62. Inner wall 74 terminates with a lip member 76 which is juxtaposed with web member 62. In this configuration, hollow flange member 64 is generally trapezoidal in cross-sectional area.

FIG. 5 is a cross-sectional view of a further embodiment of the C-section member. C-section member 80 comprises a longitudinally elongate web member 82 having a first hollow flange member 84 formed along one longitudinal edge thereof extending laterally from one side of the web 82 and a second hollow flange member 86 formed along the opposing longitudinal edge of web member 82 and extending laterally to the same side of the web as first hollow flange member 84. First and second hollow flange members 84 and 86 are comprised of structural members identical to that of hollow flange member 64 of the embodiment illustrated in FIG. 4. Namely, each has an outer wall 90 and 90*a*, an end wall 92 and 92*a*and an inner wall 94 and 94*a*, inner wall 94 and 94*a* in spaced apart non-parallel relationship to outer wall 90 and 90*a*. End walls 92 and 92*a* of first hollow flange member 84 and second hollow flange member 86 would be in substantially the same plane and substantially parallel to web 82. Inner walls 94 and 94*a* of first hollow flange member 84 and second hollow flange member 86 would terminate with a lip member 96 and 96*a* which would be juxtaposed with web member 82.

Similar advantages with respect to threaded fasteners and nail members are achieved with respect to the embodiments disclosed in FIGS. 4 and 5 as with the embodiments disclosed in FIGS. 1 and 2.

The C-shaped member, which is the subject of the present invention, may also incorporate a structure which reduces the thermal conductivity of the C-shaped member by incorporating a thermal break. FIG. 6 is a perspective partial end view of C-shaped member 30 of FIG. 2 which incorporates two types of thermal breaks. The first type of thermal break is formed on the end walls 42 and 42*a* of the hollow flanges 34 and 36 and on that portion of the web 32 positioned between the outer wall 40 and 40*a* and the inner wall 44 and 44*a* of the hollow flanges 34 and 36. The thermal break comprises a plurality of apertures 100 formed in the end walls 42 and 42*a* and in the web portion which apertures serve to reduce the surface area over which heat can be conducted. Assuming that hollow flange 34 were adjacent the exterior sheathing of the building and hollow flange 36 or adjacent the inner sheathing of a building and a temperature differential existed between the outside ambient temperature and the inside ambient temperature, the C-shaped stud 30 would tend to transmit heat from outer wall 40 across web 32 to outer wall 40*a* of hollow flange 36. Heat would also be conducted from outer wall 40 across end wall 42, down inner wall 44 to web 32 and thence to outer wall 40*a* of hollow flange 36. The apertures 100 serve as a thermal break to disrupt this conductive route and thereby lessen the amount of heat conducted. In the embodiment illustrated in FIG. 6, the apertures comprise a plurality of staggered slots formed on end walls 42 and 42*a* and that portion of web 32 bounded by the outer wall and inner wall of the hollow flange.

In addition to or separately from the slotted apertures 100 utilized to disrupt the thermal conductivity across the C-shaped member, a non-conductive material 102 may also be utilized on the outer walls of hollow flanges 34 and 36 of C-shaped member 30 or on the outer wall of hollow flange 14 and flange 16 of C-shaped member 10. This non-conductive thermal break 102 consists of a layer of non-conductive material affixed to the outer walls such that when the outer sheathing and inner sheathing are affixed to the C-shaped stud, the metal outer walls of the hollow flanges are not in direct contact with the sheathing. FIG. 6 illustrates a non-conductive material 102 having a ribbed configuration and FIG. 7 illustrates a non-conductive material 102 having a planar configuration. Both configurations serve to deter the thermal conductivity from one outer wall of C-shaped member 30 to the opposing outer wall of C-shaped member. The thermal break in the form of apertures 100 and the thermal break in the form of non-conductive material 102 may be used separately or in conjunction with each other and it will be recognized that they may also be used with respect to the embodiment of the C-shaped member illustrated in FIGS. 4 and 5.

While the present invention has been described with respect to the exemplary embodiments thereof, it will be evident to one of ordinary skill in the art that many modifications may be made without departing from the spirit and scope of the invention. Therefore it is manifestly intended that the invention be limited only by the claims and the equivalence thereof.

We claim:

1. A metal structural member comprising:

an elongate web member having a first side and a second side;

a pair of flanges extending laterally from said first side of said web member, each of said flanges having an outer wall member perpendicular to said web and an end wall member said end wall member parallel to said web member, wherein one of said flanges further having an inner wall member in spaced apart, parallel relationship with said outer wall member and extending from said end wall member perpendicular to said web and terminating with a lip member, said lip member formed parallel to said web member and juxtaposed thereto forming a structural member of generally C-shaped cross section.

2. The metal structural member in accordance with claim 1 wherein both of said flange members include said inner wall member in spaced apart, parallel relationship with said outer wall member and having said lip member formed parallel to said web member and juxtaposed thereto.

3. The metal structural member in accordance with claim 2 wherein said end wall member of said flanges and a portion of said web member between said outer wall member and said inner wall member are formed with a plurality of perforations.

4. The metal structural member in accordance with claim 3 wherein said plurality of perforations are staggered longitudinal slots.

5. The metal structural member in accordance with claim 1 wherein said outer wall member of said flanges has positioned thereon a non-heat conducting layer of insulation.

6. A method forming a metal structural member for providing multiple frictional contact points for a fastener comprising:

a. forming an elongate web member having a first side and a second side and two parallel longitudinal edges;

b. bending one longitudinal edge of said web member perpendicular to said web member to form an outer wall of a flange member;

c. bending said outer wall of said flange member to form an end wall of said flange member said end wall of said flange member being parallel to said web member;

d. bending said end member to form an inner wall member in spaced apart, parallel relationship to said outer wall of said flange member;

e. bending said inner wall of said flange member to form a lip member in parallel relationship to said web member and juxtaposed thereto;

f. performing steps b and c with respect to said second longitudinal edge of said web member.

7. The method in accordance with claim 6 wherein step f is performed simultaneously with steps b and c.

8. The method in accordance with claim 6 wherein steps f, d and e are performed simultaneously to the same side of said web member with respect to said second longitudinal edge of said web member.

* * * * *